US012385382B2

(12) United States Patent
Demirer et al.

(10) Patent No.: US 12,385,382 B2
(45) Date of Patent: Aug. 12, 2025

(54) OPTIMAL PROBABILISTIC STEERING CONTROL OF DIRECTIONAL DRILLING SYSTEMS

(71) Applicants: Halliburton Energy Services, Inc., Houston, TX (US); Board of Regents, The University of Texas System, Austin, TX (US)

(72) Inventors: Nazli Demirer, Tomball, TX (US); Robert P. Darbe, Tomball, TX (US); Alexander Mathew Keller, Austin, TX (US); Dongmei Chen, Austin, TX (US)

(73) Assignees: HALLIBURTON ENERGY SERVICES, INC., Houston, TX (US); BOARD OF REGENTS, THE UNIVERSITY OF TEXAS SYSTEM, Austin, TX (US)

( * ) Notice: Subject to any disclaimer, the term of this patent is extended or adjusted under 35 U.S.C. 154(b) by 209 days.

(21) Appl. No.: 18/125,576

(22) Filed: Mar. 23, 2023

(65) Prior Publication Data

US 2024/0318535 A1 Sep. 26, 2024

(51) Int. Cl.
*E21B 44/00* (2006.01)
*E21B 7/06* (2006.01)

(52) U.S. Cl.
CPC ..... *E21B 44/00* (2013.01); *E21B 7/06* (2013.01); *E21B 2200/20* (2020.05); *E21B 2200/22* (2020.05)

(58) Field of Classification Search
CPC ..... E21B 44/00; E21B 7/04; E21B 2200/20; E21B 2200/22; E21B 7/06; E21B 44/005; E21B 44/02
See application file for complete search history.

(56) References Cited

U.S. PATENT DOCUMENTS 10,704,388 B2 * 7/2020 Pop ..... E21B 49/0875
2012/0080197 A1 * 4/2012 Dickens ..... G01V 3/12 703/2

(Continued)

OTHER PUBLICATIONS

Georgiou, Anastasis et al., "Tracking Control for Directional Drilling Systems Using Robust Feedback Model Predictive Control", Department of Electrical and Electronic Engineering, Imperial College; IFAC PapersOnLine 53-2 (2020) 11974-11981.

(Continued)

*Primary Examiner* — Kipp C Wallace
(74) *Attorney, Agent, or Firm* — NOVAK DRUCE CARROLL LLP

(57) ABSTRACT

Aspects of the subject technology relate to systems and methods of controlling a drill string having a steerable bit when drilling a wellbore through a substrate. A deterministic model of a directional behavior of the drill string is developed that includes a drill string state, one or more drill parameters associated with the drill string, and one or more substrate parameters associated with the substrate. A stochastic differential model of the directional behavior of the drill string is then developed by replacing the state and each of the parameters of the deterministic model with respective probability distributions and adding feedback. The stochastic differential model is reduced to a truncated stochastic model by substituting a predetermined number of terms of a generalized polynomial chaos expansion for each probability distribution and then evaluating the expectations.

30 Claims, 5 Drawing Sheets

(56) References Cited

U.S. PATENT DOCUMENTS

| | | | | |
|---|---|---|---|---|
| 2016/0145991 | A1 | 5/2016 | Yarus et al. | |
| 2019/0284921 | A1* | 9/2019 | Xue | E21B 47/024 |
| 2020/0072034 | A1* | 3/2020 | Zalluhoglu | E21B 47/022 |
| 2020/0173269 | A1 | 6/2020 | Madasu et al. | |
| 2021/0103843 | A1* | 4/2021 | Keller | E21B 7/06 |
| 2021/0355805 | A1* | 11/2021 | Rangarajan | E21B 44/00 |
| 2022/0245300 | A1* | 8/2022 | Bordas | G06F 30/20 |
| 2023/0145859 | A1* | 5/2023 | Wu | E21B 7/06 175/24 |

OTHER PUBLICATIONS

Koesdwiady, Arief B. et al., "Adaptive Control for Directional Drilling Systems with Delay and Parameter Uncertainty", Robot Intelligence Technology and Applications 4, Advances in Intelligent Systems and Computing 447, DOI 10.1007/978-3-319-31293-4_11; 2017.

International Search Report & Written Opinion; PCT Application No. PCT/US2023/016278; mailed Dec. 13, 2023.

Yang, Liu et al. "A stochastic model for drilling optimization", Mathematical and Computer Modelling; vol. 29, Issue 9, May 1999, pp. 95-99.

* cited by examiner

OPTIMAL PROBABILISTIC STEERING CONTROL OF DIRECTIONAL DRILLING SYSTEMS

TECHNICAL FIELD

The present technology pertains to steering a directional drill string and, more particularly, to a system and method of controlling a steerable drill string using a controller developed from a stochastic model and probabilistic models of drill string and substrate parameters.

BACKGROUND

Steerable drill strings have been developed in order to improve extraction of oil and gas from specific underground formations. A steerable drill string has a drill bit that can be deflected in two axes perpendicular to the axis of the drill string, thereby preferentially cutting in the deflected direction and causing the wellbore to curve as the drill string advances. Control systems may also control the weight on the bit and the torque applied to the bit.

Controlling a steerable drill string relies on parameters that describe directional characteristics of the drill string. The parameters cannot usually be directly measured and must be estimated, which may result in deviations in the actual path of the drill string compared to the desired path. Furthermore, use of fixed estimates of the parameters does not account for changes in the true values of the parameters as the wellbore depth increases and the drill string advances through different types of substrate, which may lead to variable errors during drilling.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
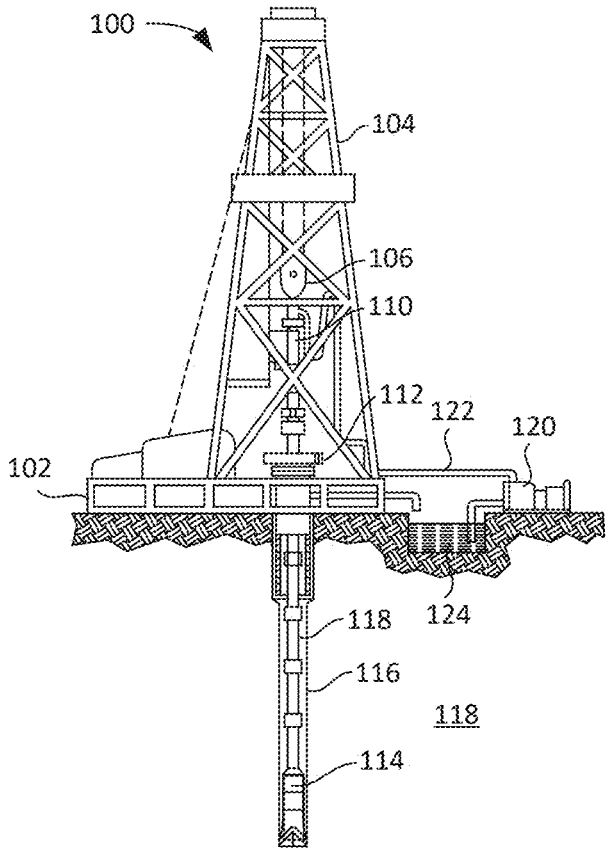
FIG. 1 is a schematic diagram of a typical wellbore drilling scenario, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The conditions at the bottom of a wellbore are difficult to measure and may vary with the depth of well. The uncertainty is magnified with a steerable drill string as the curvature of the wellbore creates additional forces that affect forces at the drill bit, which consequently affects the behavior of the bit. As it often an objective of a steerable drill string to enter a relatively shallow subterranean strata, uncertainty of the position of drill bit may prevent a successful drilling operation. Modeling of the behavior of the bottomhole assembly (BHA) is a key component of well planning and identifies the response of each BHA to variations in operating parameters, such as weight-on-bit (WOB), hole angle, overgauge or undergauge wellbore, stabilizer wear, and substrate tendencies. BHA modeling identifies the directional response to selected values of BHA design parameters, such as stabilizer diameter, drill collar length, or steering angle. The uncertainty of the values of parameters of the model, however, reduces the effectiveness of this deterministic modeling because the selected values of the parameters may vary widely from the true characteristics experienced during a particular drilling operation.

Stochastic modeling incorporates methods of evaluating the possible variation of outputs based on probability models of one or more of the parameters. True stochastic models are complex and it is not feasible to solve this type of model in a reasonable time frame while drilling a well. What is needed is a method of evaluating the probability distribution of outputs in a manageable amount of time.

The disclosed technology addresses the foregoing by creating a full stochastic model of the behavior at the BHA then reducing this stochastic model to a deterministic form that can be solved to predict a mean and variance of the output in an acceptable amount of time. The stochastic model is modified using generalized polynomial chaos (gPC) theory to convert the continuous differential equation into a discrete problem that can be solved in a relatively short amount of time. An optimal controller is then developed based on this truncated stochastic model with feedback, constraints, and a cost function. The cost function can be linear or nonlinear and evaluate one or more outputs, such as the position of the bit, an inclination of the wellbore at the bit, and/or the curvature of wellbore. Comparative simulations indicate that the disclosed controller is superior to a conventional deterministic controller in many regards.

Turning now to FIG. 1A, a typical drilling arrangement 100 is shown in schematic form, in accordance with various aspects of the subject technology. A drilling platform 102 is equipped with a derrick 104 that supports a hoist 106 for raising and lowering a drill string 108. The hoist 106 suspends a top drive 110 suitable for rotating and lowering the drill string 108 through a well head 112. A drill bit 114 is connected to the lower end of the drill string 108. Torque is applied to drill bit 114 by a drive motor (not visible in FIG. 1) that may be disposed on the drilling platform, e.g., rotating the entire drill string 108, or at the bottom of the drill string 108, e.g., a drill motor that rotates only the bit 114. A down force may also be controllably applied to the bit 114 by one or more of the weight of the drill string 108, the placement of drill collars 114 on the drill string 108, and a pull-down drive (not visible in FIG. 1). As the drill bit 114 rotates, it creates a wellbore 116 that passes through one or more subterranean substrates 118. A pump 120 circulates drilling fluid through a supply pipe 122 to top drive 110, down through the interior of drill string 108 and out orifices in drill bit 114 into the wellbore 116. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116.

Figure 2:
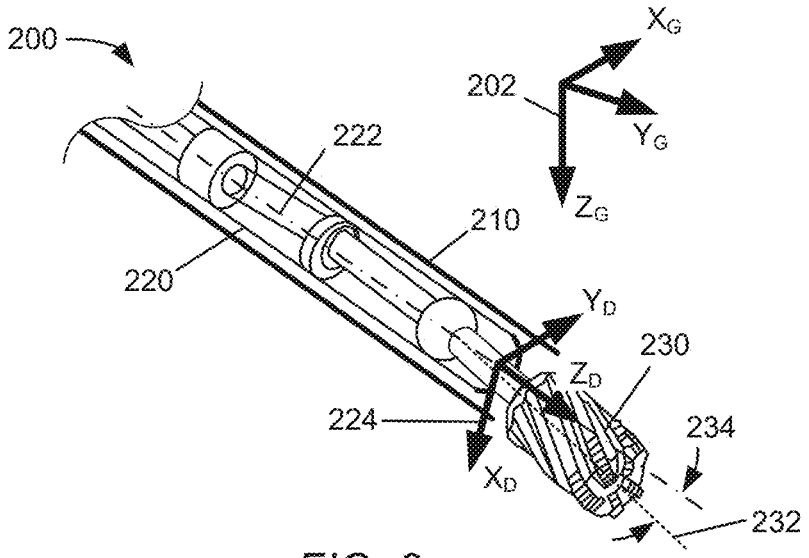
FIG. 2 is a perspective view of an exemplary steerable drill bit of a drill string, in accordance with various aspects of the subject technology.

FIG. 2 is a perspective view of an exemplary drill string 200 having a steerable bit 230, in accordance with various aspects of the subject technology. The drill string 200 comprises a lower portion 220 having a centerline 222 and a local coordinate system 224 having a first axis $Z_D$ that is aligned with the centerline 222 and axes $X_D$ and $Y_D$ that are perpendicular to $Z_D$ and to each other. The bit 230 has a centerline 232 and is controllably disposed at an angle 234 to the centerline 222 of the drill string 220. In certain embodiments, the angle 234 is a first angle in the X-Z plane of coordinate system 224 and a second angle in the Y-Z plane of coordinate system 224.

The drill bit 230 has a state that includes one or more of a position, an inclination, and a curvature of the wellbore 116 at the bit 230 and derivatives thereof. In certain embodiments, the position of the bit 230 is defined at the 3D position of the center of coordinate system 224 in the global coordinate system 202, which is fixed in the substrate 118 with axis $Z_G$ pointed "down" as defined by gravity and axes $X_G$ and $Y_G$ that are perpendicular to $Z_G$ and to each other. In certain embodiments, the inclination is defined as the angle between $Z_D$ and $Z_G$. In certain embodiments, the curvature of the wellbore 116 is defined in terms of degrees of a planar change in $Z_D$ per 100 feet of drill string 108, evaluated at the center of local coordinate system 224.

Figure 3:
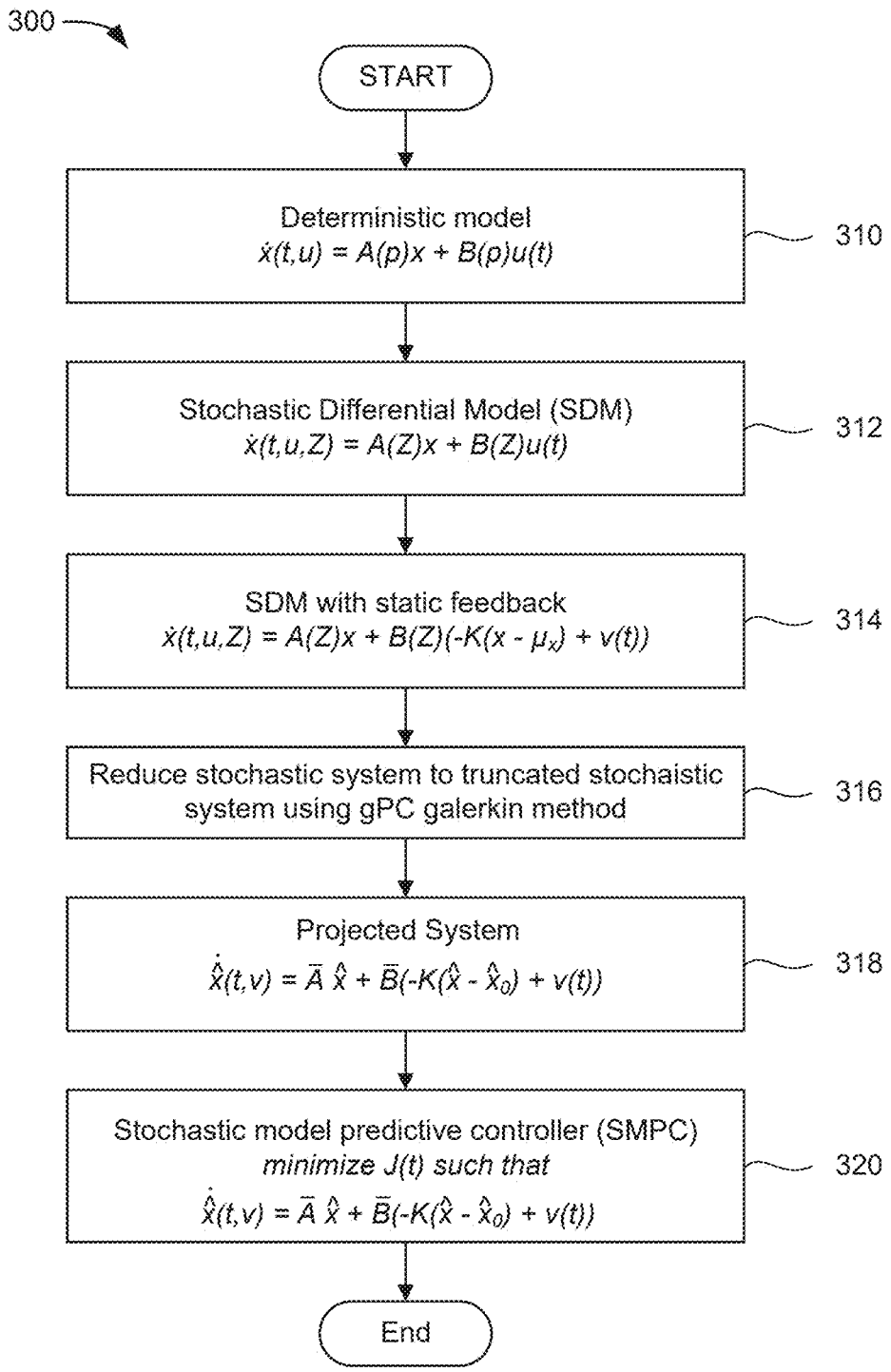
FIG. 3 is an exemplary workflow for creating a stochastic model predictive controller (SMPC), in accordance with various aspects of the subject technology.

FIG. 3 is an exemplary workflow 300 for creating a stochastic model predictive controller (SMPC), in accordance with various aspects of the subject technology. The method begins in step 310 by developing a deterministic model of the directional behavior through first principles or a data-based approach. In this embodiment, a linear model is used, but the model can be non-linear in general. The deterministic equation of the model is:

$$\dot{x}(t, u) = A(p)x(t) + B(p)u(t),\ x(0) = x_0, \qquad \text{Equation 1}$$

where x is the vector of states, which includes the attitude of the bit and its derivative, i denotes differentiation with respect to the independent variable t, $x_0$ is the vector of initial states, u is the vector of control inputs, and system matrices A, B depend on the properties of the drilling system and the vector of parameters p. Here, the parameters are deterministic:

$$p = (p_1, \dots p_n) \in \mathbb{R}^n \qquad \text{Equation 2}$$

Step 312 characterizes the parametric uncertainty of the model due to measurement and or experiment limitations. Parameters p are substituted with mutually independent random variables:

$$Z(\omega) = (Z_1(\omega), \dots Z_d(\omega)) \text{ wherein } 1 \le d \le n \text{ and } \omega \in \Omega \qquad \text{Equation 3}$$

that denotes random inputs in the probability space (Ω,F, P). Z(ω) has a prescribed cumulative distribution function (CDF):

$$F_Z(z) = P(Z \le z),\ z \in \mathbb{R}^n \qquad \text{Equation 4}$$

that models the uncertainty of the parameters and can be determined with Bayesian-based parameter estimation for instance. This procedure results in the stochastic differential model (SDM):

$$\dot{x}(t, u, Z) = A(Z)x(t) + B(Z)u(t),\ x(t = 0) = x_0 \qquad \text{Equation 5}$$

This model describes the evolution of the drilling system in open-loop operation. Feedback control reduces the uncertainty of the system. Therefore, step 314 adds a feedback term:

$$u(t) = -K(x(t) - \mu_x) + v(t) \qquad \text{Equation 6}$$

to the model to better approximate the closed-loop behavior of the drilling system. This reduces the conservatism of control and constraint backoff. The modified stochastic model is thus:

$$\dot{x}(t, v, Z) = A(Z)x(t) + B(Z)(-K(x(t) - \mu_x) + v(t)) \qquad \text{Equation 7}$$

where K is a constant gain matrix selected according to the particular system, $\mu_x$ is the mean of x, and v is the deterministic control input.

In general, the solution of the stochastic model is too expensive to compute for use in real-time control. Instead, the stochastic system is reduced in step 316 to a deterministic system through application of gPC theory using the Galerkin method. Step 316 can alternately reduce the system using an arbitrary polynomial chaos (aPC) method. For clear exposition, variable $Z(\omega)$ is considered univariate and the system is scalar, but the method applies to multivariate random variables and multi-input, multi-output systems as well. The random variable $Z(\omega)$ has finite moments and a probability density function (PDF) $\rho(z)$ such that:

$$\rho(z)dz = dF_Z(z) \quad \text{Equation 8}$$

Based on its distribution, $Z(\omega)$ has associated gPC basis functions that belong to a system of orthogonal polynomials with respect to the real positive measure z with density equivalent to $\rho(z)$. The basis functions $\{\Phi_k(Z)\}$ satisfy the following orthogonality relation:

$$\mathbb{E}[\Phi_m(Z)\Phi_n(Z)] = \gamma_n\delta_{mn},\ m, n \in \mathbb{N} \quad \text{Equation 9}$$

where, $$\gamma_n = \mathbb{E}\left[\Phi_n^2(Z)\right],\ n \in \mathbb{N} \quad \text{Equation 10}$$

and $\delta_{mn}$ is the Kronecker delta function

First, the state x is substituted by its truncated gPC expansion in the polynomial basis functions:

$$x(t, v, Z) \approx \sum_{i=0}^{N} \hat{x}_i(t, v)\Phi_i(Z), \quad \text{Equation 11}$$

which is exact when $N\rightarrow\infty$. Next, the random parameters are substituted by their gPC expansions. The stochastic system is then projected onto the space spanned by $\{\Phi_k(Z)\}$:

$$\mathbb{E}[\dot{x}(t, v)\Phi_k(Z)] = \mathbb{E}[(Ax(t) + B(-K(x(t) - \mu_x) + v(t)))\Phi_k(Z)], \quad \text{Equation 12}$$

$$\hat{x}_k(t = 0) = \mathbb{E}[x_0\Phi_k(Z)]/\gamma_k \quad \text{Equation 13}$$

$$\forall\ k = 0, \ldots, N. \quad \text{Equation 14}$$

Step 318 computes the expectations and exploiting the orthogonality relation removes the dependence on the random variable, making the projected system a truncated stochastic model (TSM). After evaluating the expectations, the projected system is:

$$\dot{\hat{x}}(t, v) = \overline{A}\hat{x}(t) + \overline{B}(-K(\hat{x}(t) - \hat{x}_0) + v(t)), \quad \text{Equation 15}$$

where $\overline{A}$, $\overline{B}$ are the projected system matrices. Statistics of the TSM can be computed from the solution of the projected system. The mean of the state x is approximated by:

$$\mathbb{E}[x(t, v, Z)] = \mu_x \approx \hat{x}_0(t), \quad \text{Equation 16}$$

and the variance is approximated by:

$$\text{var}(x(t, v, Z)) = \sigma_x^2 \approx \sum_{i=0}^{N} \hat{x}_i^2(t, v)\gamma_i \quad \text{Equation 17}$$

Step 320 creates a stochastic model predictive controller (SMPC) that solves the optimization problem that comprises the TSM, a cost function, and a constraint. For example, an exemplary optimization problem is:

$$\min_v J(t) \quad t \in (0, T) \quad \text{Equation 18}$$

$$\text{such that} \begin{cases} J(t) = \left|(\hat{x}_0 - r)^T q\right| \\ \dot{\hat{x}} = \overline{A}\hat{x} + \overline{B}(-K(\hat{x} - \hat{x}_0) + v) \\ \hat{x}_0(t = 0) = x_0 \\ Prob\left\{a_j^T x \le b_j + c_j r\right\} \ge 1 - \epsilon_j & \forall\ j = 0, \ldots, n_j \\ Prob\left\{d_k^T(-K(\hat{x} - \hat{x}_0) + v) \le e_k\right\} \ge 1 - \epsilon_k & \forall\ k = 0, \ldots, n_k \end{cases}$$

In certain embodiments, the state x includes at least one state variable selected from the group of a position of the bit, an inclination of the drill string at the bit, and a curvature of the wellbore at the bit. In this example, the state includes the mean position, the mean inclination, and mean curvature of the wellbore at the bit.

The first term defines the cost function J(t) which attributes a linear cost with a weight q to the tracking error between the mean state trajectory $\hat{x}_0 \approx \mu_x$ and the reference trajectory r(t). This includes the tracking error between the mean position, mean inclination, and mean curvature at the bit and the reference position, reference inclination, and reference curvature at the bit. In certain embodiments, the cost function comprises one or more of a variance of the projected path of the drill string, a difference between a projected state of the drill string and a first constraint, and a difference between a candidate control input and a second constraint.

The second term defines an equality constraint that enforces the dynamics of the projected system with static feedback.

The third term defines an equality constraint that enforces the initial conditions of the projected system. Specifically, the mean of the projected states x is equal to $x_0$ which is a measurement or an estimate of the states at the time the optimization problem is solved.

The fourth term defines $n_j$ linear state constraints that are enforced probabilistically. In other words, the probability of satisfying $a_j^T x \le b_j + c_j r$ must be greater than or equal to $1-\epsilon_j$, where $\epsilon_j \in (0,1)$ is an operator defined risk level. Included in these example constraints are upper and lower bounds on the deviation of the inclination of the bit from the reference trajectory and a bound on the maximum curvature of the borehole at the bit. These constraints have the following equivalent form which is implemented as a second order cone constraint:

$$a_j^T\hat{x}_0 + f_j(\epsilon)\sqrt{\text{Var}\left[a_j^T x\right]} \le b_j + c_j r, \quad \text{Equation 19}$$

where the function $f_j(\epsilon)$ is chosen to enforce the constraint robustly or approximately. The approximate form adopted in this embodiment is the inverse CDF of the standard normal:

$$f_j(\epsilon) = \Phi^{-1}(1-\epsilon_j)t, \quad \text{Equation 20}$$

In certain embodiments, the constraints include one or more of a respective maximum value for one or more of the selected state variables and a respective maximum value for one or more of the selected control variables, e.g., a steering angle of the bit, a torque on the bit, and a weight on the bit.

The fifth term defines $n_k$ linear input constraints that are enforced probabilistically according to the risk level $\epsilon_k$. These constrain the total input (the sum of static feedback and deterministic control input) to be not greater than $\epsilon_k$. In this embodiment, $e_k=d_k=1$. They are implemented in the same manner as the state constraints of the fourth term.

In certain embodiments, the controller created in step 320 is designed using a Robust Model Predictive Controller (MPC), a tube MPC, or a scenario-based MPC.

Figure 4:
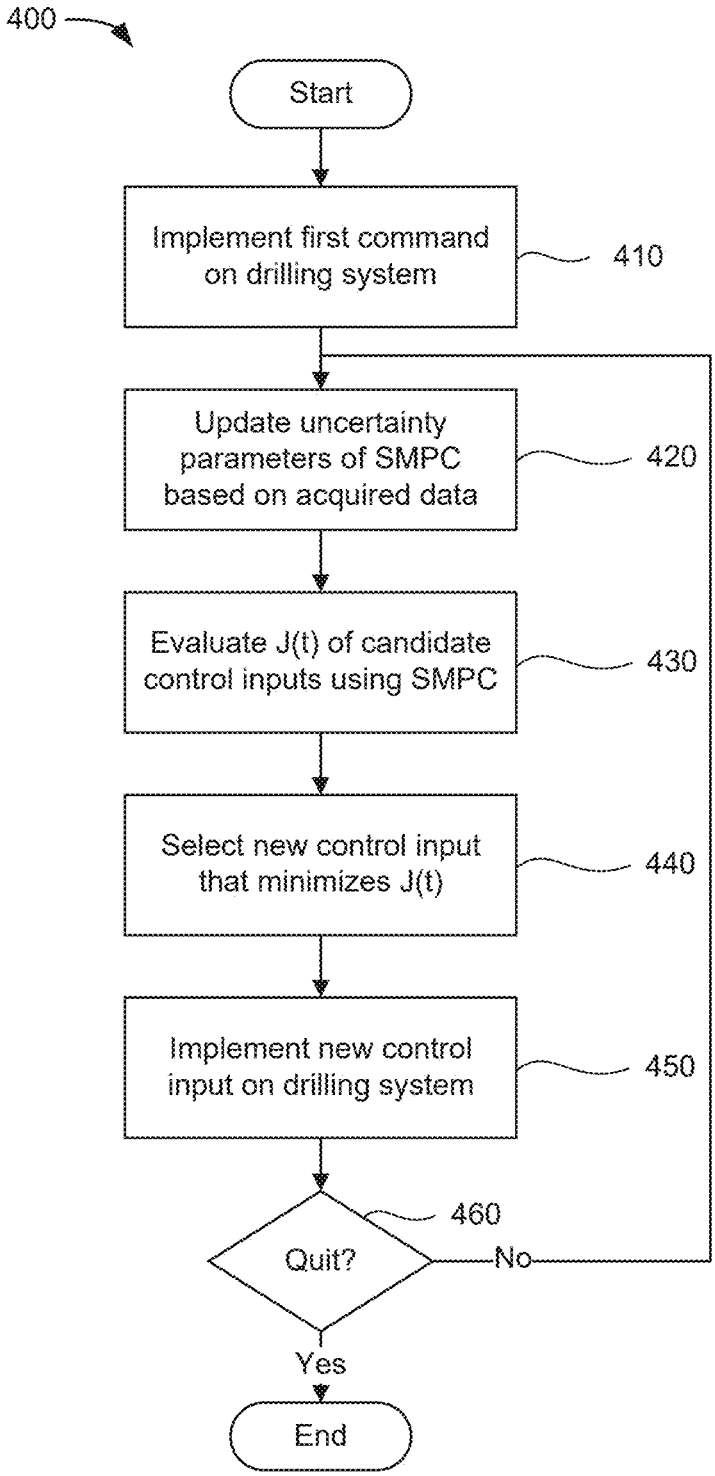
FIG. 4 is an exemplary workflow for controlling a steerable drill string in accordance with various aspects of the subject technology.

FIG. 4 is an exemplary workflow 400 for controlling a steerable drill string in accordance with various aspects of the subject technology. The first command is implemented on the drilling system in step 410. In optional step 420, new measurements/estimates of the states are attained and the uncertainty parameters of the SMPC are updated. In this manner, an initial parameter value need not be precise and will be refined as the drilling progresses.

Step 430 uses the new measurements of step 420 to solve the optimization problem again using the SMPC. This may include performing evaluations of J(t) according to Equation 18.

New control inputs are selected in step 440. This may include selecting a control input that minimizes J(t). In certain embodiments, the control input is updated upon occurrence of an event, e.g., a difference between the current state of the drill string and a desired state of the drill string exceeds a first threshold, a variance associated with the current state of the drill string exceeds a second threshold, or a distance advanced by the drill string since a prior update of the control input exceeds a third threshold.

Step 460 branches back to step 420 for continued operation and branches to termination of the control workflow if it desired to quit drilling.

Figure 5:
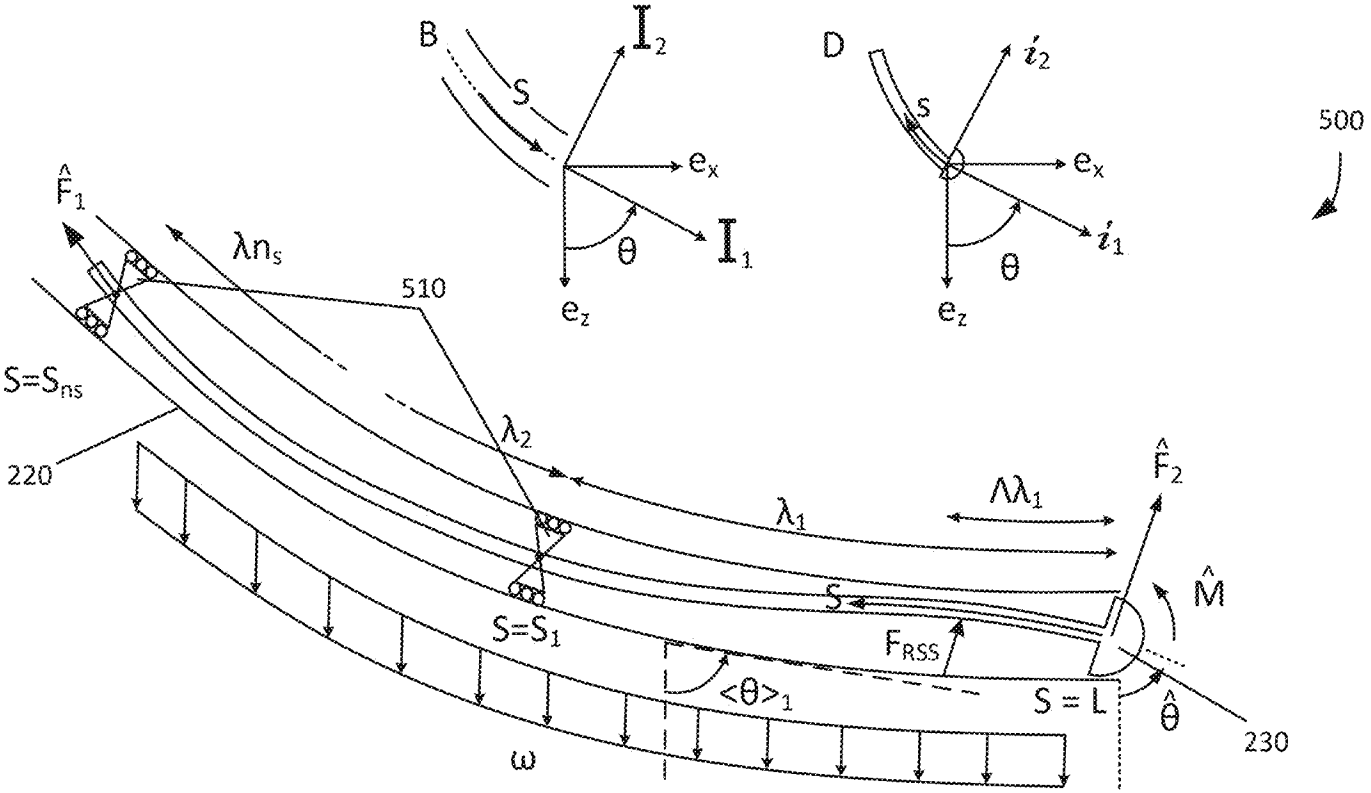
FIG. 5 depicts the geometry of a two-stabilizer bottomhole assembly, in accordance with various aspects of the subject technology.

FIG. 5 depicts the geometry of a two-stabilizer BHA 500, in accordance with various aspects of the subject technology. The BHA 500 includes the bottom portion of the drill string 220 and drill bit 230. Stabilizers 510 are positioned along the drill string 220 at distances λ. BHA modeling identifies the directional response to BHA design parameters, such as stabilizer diameter, drill collar length, or steering angle of the bit 230. Drill-ahead models account for a constantly changing wellbore path.

The state-space model used for these trials is based on:

$$x'(\xi, p) = A_0(p)x(\xi) + \sum_{i=1}^{n_s} A_i(p)x(\xi-\delta_i) + B(p)u(\xi) \quad \text{Equation 21}$$

where, $$x(\xi) := \left[\Theta(\xi), \langle\Theta\rangle_1(\xi), \ldots, \langle\Theta\rangle_{n_s}(\xi), \tilde{d}(\xi)\right]^T \in \mathbb{R}^n,$$

and,

-continued $$u(\xi) := [\Gamma(\xi), \sin\Theta_r(\xi), \Theta_r(\xi)]^T.$$

$$\tilde{d}(\xi) = \tilde{d}_0 + \int_0^{\xi} \Theta(\sigma) - \Theta_r(\sigma)d\sigma, \quad \text{Equation 22}$$

x—state vector
u—input vector
p—parameter vector
ξ—normalized drilled distance
Θ—borehole inclination at the bit
$\Theta_r$—reference borehole inclination
Γ—normalized RSS pad force
$\langle\Theta\rangle_i$—average borehole inclination between $i^{th}$ and $(i-1)^{th}$ stabilizer with $\langle\Theta\rangle_1$ denoting the average borehole inclination between the first stabilizer and the bit
$\tilde{d}$—normalized position deviation of the bit with respect to the reference position
$\tilde{d}_0$—normalized initial position deviation
$\kappa_i$—normalized distance between $i^{th}$ and $(i-1)^{th}$ stabilizer with $\kappa_1$ denoting the normalized distance between the first stabilizer and the bit
$\mathcal{M}, \mathcal{F}$—constant coefficients that depend on BHA geometry, defined below
χ—normalized angular steering resistance parameter
η—normalized lateral steering resistance parameter
Π—normalized weight on bit The system matrices of the SMPC model in state-space form are:

$$A_0 = \frac{1}{\chi\Pi}\begin{bmatrix} -\mathcal{M}_b + \frac{\chi}{\eta}\left(\mathcal{F}_b - \frac{\mathcal{F}_1}{\kappa_1}\right) & \mathcal{M}_b + R & -R & 0 \\ \frac{\chi\Pi}{\kappa_1} & 0 & 0 & 0 \\ 0 & 0 & 0 & 0 \\ 1 & 0 & 0 & 0 \end{bmatrix}$$

where, $R = (\mathcal{F}_b\mathcal{M}_1 - \mathcal{F}_1\mathcal{M}_b - \mathcal{M}_1\eta\Pi)/(\eta\Pi)$, $$A_1 = \begin{bmatrix} \frac{\chi}{\eta}\left(\frac{\mathcal{F}_1}{\kappa_1} + \frac{\mathcal{F}_1}{\kappa_2} - \mathcal{F}_b\right) & 0 & 0 & 0 \\ -\frac{\chi\Pi}{\kappa_1} & 0 & 0 & 0 \\ \frac{\chi\Pi}{\kappa_2} & 0 & 0 & 0 \\ 0 & 0 & 0 & 0 \end{bmatrix},$$

$$A_2 = \frac{1}{\chi\Pi}\begin{bmatrix} -\frac{\chi\mathcal{F}_1}{\eta\kappa_2} & 0 & 0 & 0 \\ 0 & 0 & 0 & 0 \\ -\frac{\chi\Pi}{\kappa_2} & 0 & 0 & 0 \\ 0 & 0 & 0 & 0 \end{bmatrix},$$

$$B = [B_0, B_1, B_2],$$

$$B_0 = \frac{1}{\chi\Pi}\left[\frac{\mathcal{F}_b\mathcal{M}_r - \mathcal{F}_r\mathcal{M}_b - \mathcal{M}_r\eta\Pi}{\eta\Pi} \quad 0 \quad 0 \quad 0\right]^T,$$

$$B_1 = \frac{\gamma}{\chi\Pi}\left[\frac{\mathcal{F}_b\mathcal{M}_\omega - \mathcal{F}_\omega\mathcal{M}_b - \mathcal{M}_\omega\eta\Pi}{\eta\Pi} \quad 0 \quad 0 \quad 0\right]^T,$$

$$B_2 = [0 \quad 0 \quad 0 \quad -1]^T.$$

The coefficients of influence for a two-stabilizer BHA are:

$$\mathcal{F}_b = \frac{-6-4\kappa_2}{3+4\kappa_2},$$

-continued $$\mathcal{F}_\omega = \frac{6 + 10\kappa_2 - 3\kappa_2^3}{12 + 16\kappa_2},$$

$$\mathcal{F}_r = \frac{-3 - 4\kappa_2 + \Lambda^2(9 + 6\kappa_2) - 2\Lambda^3(3 + \kappa_2)}{3 + 4\kappa_2},$$

$$\mathcal{F}_1 = \frac{6}{3 + 4\kappa_2},$$

$$\mathcal{M}_b = \frac{4(1 + \kappa_2)}{3 + 4\kappa_2}$$

$$\mathcal{M}_\omega = \frac{-1 - 2\kappa_2 + \kappa_2^3}{12 + 16\kappa_2}$$

$$\mathcal{M}_r = \frac{\Lambda(3 + 4\kappa_2) - 6\Lambda^2(1 + \kappa_2) + \Lambda^3(3 + 2\kappa_2)}{3 + 4\kappa_2},$$

$$\mathcal{M}_1 = \frac{-2}{3 + 4\kappa_2}.$$

wherein, $$\Pi \in [0.05, 0.3],$$

$$\eta \in [3, 30].$$

Figure 6A:
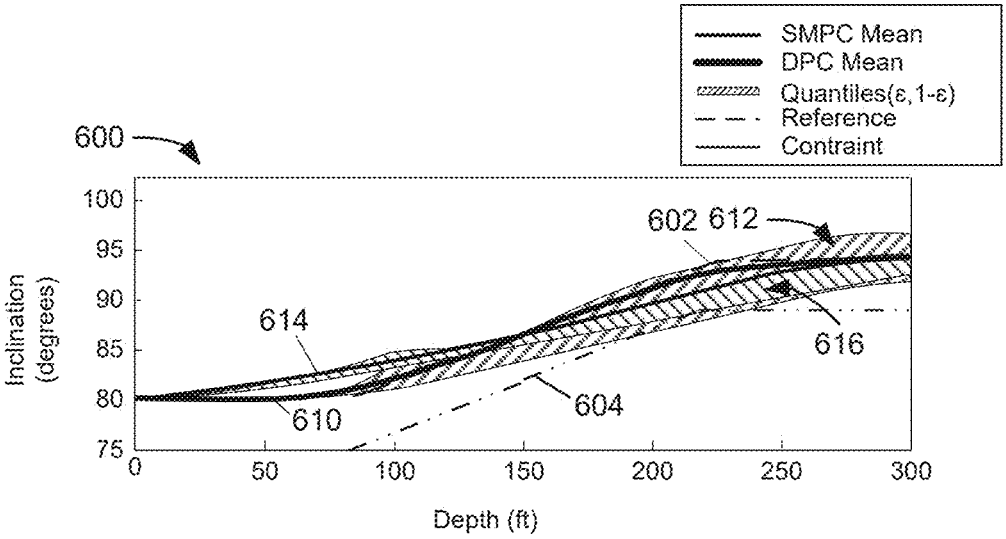
FIGS. 6A-6C depict simulation results comparing the behavior of a SMPC-controlled drill string to a deterministic model controller, in accordance with various aspects of the subject technology.
Figure 6B:
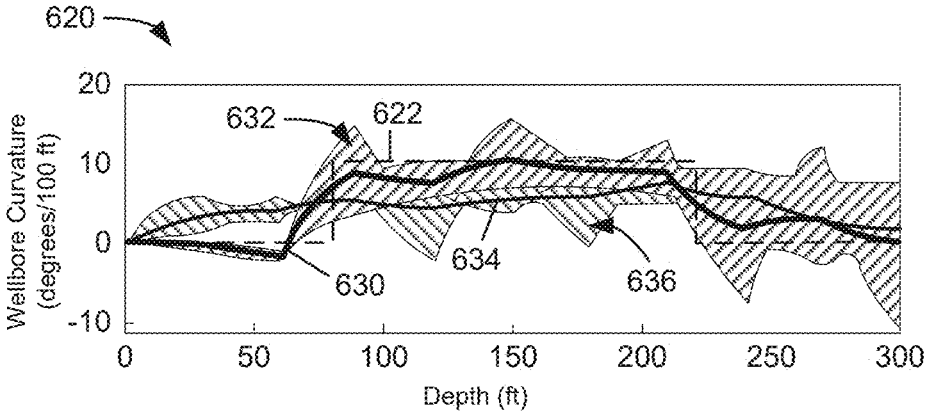
Figure 6C:
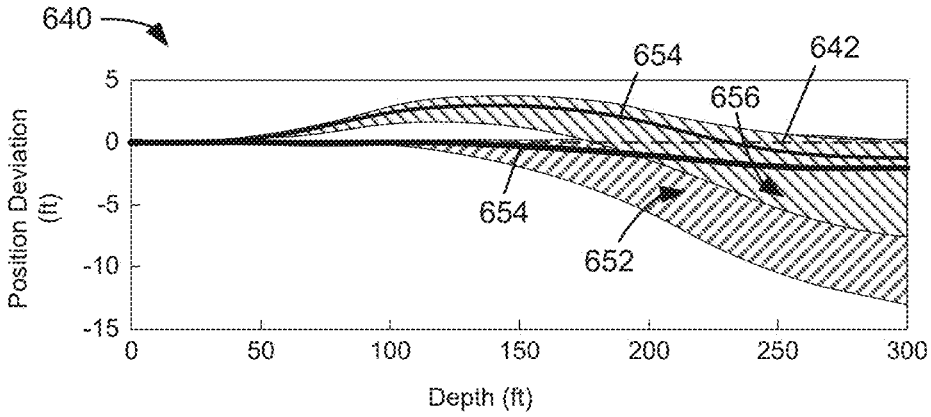

FIGS. 6A-6C depict simulation results comparing the behavior of a SMPC-controlled drill string to a deterministic controller, in accordance with various aspects of the subject technology. Monte Carlo simulations were performed with (1) an uncertain model of a rotary steerable system controlled by a deterministic predictive controller (DPC) and (2) an exemplary SMPC as disclosed herein. One hundred (100) trials were conducted with each controller using random realizations of the model parameters. The initial conditions of these trials were treated as deterministic but can be treated as random variables to incorporate uncertainty due to measurement/estimation error.

The parameter values used for these trials are listed in Table 1.

TABLE 1

| $\lambda_1$(m) | $\lambda_2$ (m) | $\Lambda$ | EI (MNm$^2$) | $\chi$ |
|---|---|---|---|---|
| 3.66 | 6.1 | 0.61 | 7.35 | 0.1 |

These same parameters may take on a range of values, depending on the particular drill string and the substrate. Example ranges are listed in Table 2.

TABLE 2

| $\lambda_1$(m) | $\lambda_2$ (m) | $\Lambda$ | EI (MNm$^2$) | $\chi$ |
|---|---|---|---|---|
| 1-15 | 1-15 | 0.1-5 | 0.1-10 | 0.01-100 |

FIG. 6A is a plot 600 depicting a reference inclination 602 of a wellbore over a 300-foot distance, starting at an angle of 80 degrees and changing to approximately 94 degrees over approximately 140 feet, beginning at the 80-foot distance. A constraint 604 has been established approximately 6 degrees less than the reference 602.

The deterministic predictive controller (DPC) mean inclination 610 follows the reference path 602 fairly closely and has an uncertainty shown as shaded zone 612 that infringes the constraint 604 at approximately 200 feet. The SMPC mean inclination 614 departs from the reference 602 earlier than DPC 610 and reaches the desired 94 degree angle at approximately the same distance as DPC 610. The SMPC uncertainty 616, however, is smaller than the equivalent DPC uncertainly 612 at all distances and, notably, does not infringe the restraint 604.

FIG. 6B is a plot 620 depicting the wellbore curvature, also known as "dogleg severity," of the same trials as FIG. 6A. The reference curvature 622 steps from zero to 10 degrees/100 ft at 80 ft and back to zero at 220 ft. In these trials, the control inputs were updated at fixed intervals of approximately 30 ft. The DLC mean 630 goes negative at a first update at approximately 30 ft and then adjusts upward at the second adjustment at approximately 60 ft. The DPC uncertainly 632 peaks at approximately 16 degrees/100 ft and later reaches −10 degrees/100 ft when the reference is zero. The SMPC mean 634 does not rise to the target 10 degrees/100 ft and the SMPC uncertainty 636 peaks at approximately 13 degrees/100 ft.

FIG. 6C is a plot 640 depicting the position deviation of the bit from the reference path 642 in the same trials as FIG. 6A. The DPC mean 650 drifts "upward" (a negative position error) starting at approximately 160 feet and reaches a maximum of approximately −2 feet of deviation. The DPC uncertainty 652, however, is biased in the negative direction and reaches a maximum of approximately −13 feet at the end of the trial distance. The SMPC mean 654 drift "downward" (positive position error) initially then returns to the reference position at 200 feet and ends at approximately −2 feet of deviation. The SMPC uncertainty 656 is also biased in the negative direction but reaches a maximum of −8 feet at the end of the trial distance, which compares favorably with the DPC uncertainty 652.

The results presented in FIGS. 6A-6C demonstrate constraint satisfaction and a smaller spread of trajectories for the SMPC compared to the DPC.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

A method of controlling a drill string having a steerable bit when drilling a wellbore through a substrate, comprising developing a deterministic model of a directional behavior of the drill string comprising a drill string state; one or more drill parameters associated with the drill string; and one or more substrate parameters associated with the substrate. The method also includes developing a SDM of the directional behavior of the drill string by replacing the state and each of the parameters of the deterministic model with respective probability distributions and adding feedback; reducing the SDM to a TSM by substituting a predetermined number of terms of a gPC expansion for each probability distribution and then evaluating the expectations.

A non-transitory computer-readable storage medium comprising instructions for controlling a drill string having a steerable bit when drilling a wellbore through a substrate that, when loaded into a processor, cause the processor to execute the steps of developing a deterministic model of a directional behavior of the drill string comprising a drill string state, one or more drill parameters associated with the drill string, and one or more substrate parameters associated with the substrate. The instructions also cause the processor to execute the steps of developing a SDM of the directional behavior of the drill string by replacing the state and each of the parameters of the deterministic model with respective probability distributions and adding feedback; and reducing the SDM to a TSM by substituting a predetermined number of terms of a gPC expansion for each probability distribution and then evaluating the expectations.

A system for controlling a drill string having a steerable bit when drilling a wellbore through a substrate, comprising a processor and a non-transitory computer-readable storage medium coupled to the processor and comprising instructions that, when loaded into the processor, cause the processor to execute the steps of developing a deterministic model of a directional behavior of the drill string comprising a drill string state, one or more drill parameters associated with the drill string, and one or more substrate parameters associated with the substrate; developing a SDM of the directional behavior of the drill string by replacing the state and each of the parameters of the deterministic model with respective probability distributions and adding feedback; and reducing the SDM to a TSM by substituting a predetermined number of terms of a gPC expansion for each probability distribution and then evaluating the expectations.

What is claimed is:

1. A method of controlling a drill string having a steerable bit when drilling a wellbore through a substrate, comprising:

developing a deterministic model of a directional behavior of the drill string comprising:

a drill string state;

one or more drill parameters associated with the drill string; and one or more substrate parameters associated with the substrate;

developing a stochastic differential model (SDM) of the directional behavior of the drill string by replacing the state and each of the parameters of the deterministic model with respective probability distributions and adding feedback;

reducing the SDM to a truncated stochastic model (TSM) using a stochastic approximation method;

creating a controller which incorporates operation of the TSM; and controlling the drill string using a control input from the controller.

2. The method of claim 1, wherein the drill string state comprises at least one state variable selected from the group of: a position of the bit, an inclination of the drill string at the bit, and a curvature of the wellbore at the bit.

3. The method of claim 2, wherein a projected path of the drill string is identified by calculating at least one of a mean and a variance for at least one of the state variables along the projected path from a current position of the drill string.

4. The method of claim 3, further comprising:

projecting the drill string state over a horizon using the TSM and a plurality of candidate control inputs;

calculating a respective cost function for each candidate control input of the plurality of candidate control inputs; and selecting a candidate control input of the plurality of candidate control inputs based on a lowest cost function being associated with the selected candidate control input.

5. The method of claim 4, wherein each of the respective cost functions comprises one or more of the group:

a difference between the mean of the projected path of the drill string and a portion of a reference path;

the variance of the at least one of the state variables along the projected path;

a difference between a projected drill string state and a first constraint; and a difference between a candidate control input and a second constraint.

6. The method of claim 5, wherein:

the first constraint comprises a respective maximum value for one or more of the selected state variables;

the candidate control input comprises one or more control variables selected from a group of a steering angle, a torque, and a weight; and the second constraint comprises a respective maximum value for one or more of the selected control variables.

7. The method of claim 3, wherein the controller is a stochastic model predictive controller (SMPC), further comprising:

selecting a new control input using the SMPC that comprises the TSM, a cost function, and a constraint; and updating a current control input with the new control input upon occurrence of an event within the group of:

a difference between the current state of the drill string and a desired state of the drill string exceeds a first threshold;

a variance associated with the current state of the drill string exceeds a second threshold; and a distance advanced by the drill string since a prior update of the control input exceeds a third threshold.

8. The method of claim 3, further comprising:

selecting a new control input using a robust control method selected from a group of a robust Model Predictive Controller (MPC), a tube MPC, and a scenario-based MPC.

9. The method of claim 1, wherein the stochastic approximation method is selected from a group of a generalized polynomial chaos (gPC) method and an arbitrary polynomial chaos (aPC) method.

10. The method of claim 1, wherein reducing the SDM to a TSM comprises substituting a predetermined number of terms of expansion for each probability distribution in the stochastic approximation method and then evaluating one or more expectations.

11. A non-transitory computer-readable storage medium comprising instructions for controlling a drill string having a steerable bit when drilling a wellbore through a substrate that, when loaded into a processor, cause the processor to execute the instructions to:

develop a deterministic model of a directional behavior of the drill string comprising:

a drill string state;

one or more drill parameters associated with the drill string; and one or more substrate parameters associated with the substrate;

develop a stochastic differential model (SDM) of the directional behavior of the drill string by replacing the state and each of the parameters of the deterministic model with respective probability distributions and adding feedback;

reduce the SDM to a truncated stochastic model (TSM) using a stochastic approximation method;

create a controller which incorporates operation of the TSM; and control the drill string using a control input from the controller.

12. The storage medium of claim 11, wherein the drill string state comprises at least one state variable selected from the group of: a position of the bit, an inclination of the drill string at the bit, and a curvature of the wellbore at the bit.

13. The storage medium of claim 12, wherein a projected path of the drill string is identified by calculating at least one of a mean and a variance for at least one of the state variables along the projected path from a current position of the drill string.

14. The storage medium of claim 13, further comprising instructions that cause the processor to:

project the drill string state over a horizon using the TSM and a plurality of candidate control inputs;

calculate a respective cost function for each candidate control input of the plurality of control inputs; and select a candidate control input of the plurality of candidate control inputs based on a lowest cost function being associated with the selected candidate control input.

15. The storage medium of claim 14, wherein each of the respective cost functions comprises one or more of the group:

a difference between the mean of the projected path of the drill string and a portion of a reference path;

the variance of the at least one of the state variables along the projected path;

a difference between a projected drill string state and a first constraint; and a difference between a candidate control input and a second constraint.

16. The storage medium of claim 15, wherein:

the first constraint comprises a respective maximum value for one or more of the selected state variables;

the candidate control input comprises one or more control variables selected from a group of a steering angle, a torque, and a weight; and the second constraint comprises a respective maximum value for one or more of the selected control variables.

17. The storage medium of claim 13, wherein the controller is a stochastic model predictive controller (SMPC), further comprising:

selecting a new control input using the SMPC that comprises the TSM, a cost function, and a constraint; and updating a current control input with the new control input upon occurrence of an event within the group of:

a difference between the current state of the drill string and a desired state of the drill string exceeds a first threshold;

a variance associated with the current state of the drill string exceeds a second threshold; and a distance advanced by the drill string since a prior update of the control input exceeds a third threshold.

18. The storage medium of claim 13, further comprising:

selecting a new control input using a robust control method selected from a group of a robust Model Predictive Controller (MPC), a tube MPC, and a scenario-based MPC.

19. The storage medium of claim 11, wherein the stochastic approximation method is selected from a group of a generalized polynomial chaos (gPC) method and an arbitrary polynomial chaos (aPC) method.

20. The storage medium of claim 11, wherein reducing the SDM to a TSM comprises substituting a predetermined number of terms of expansion for each probability distribution in the stochastic approximation method and then evaluating one or more expectations.

21. A system for controlling a drill string having a steerable bit when drilling a wellbore through a substrate, comprising:

a processor; and a non-transitory computer-readable storage medium coupled to the processor and comprising instructions that, when loaded into the processor, cause the processor to:

develop a deterministic model of a directional behavior of the drill string comprising:

a drill string state;

one or more drill parameters associated with the drill string; and one or more substrate parameters associated with the substrate;

develop a stochastic differential model (SDM) of the directional behavior of the drill string by replacing the state and each of the parameters of the deterministic model with respective probability distributions and adding feedback;

reduce the SDM to a truncated stochastic model (TSM) using a stochastic approximation method;

create a controller which incorporates operation of the TSM; and control the drill string using a control input from the controller.

22. The system of claim 21, wherein the drill string state comprises at least one state variable selected from the group of: a position of the bit, an inclination of the drill string at the bit, and a curvature of the wellbore at the bit.

23. The system of claim 22, wherein a projected path of the drill string is identified by calculating at least one of a mean and a variance for at least one of the state variables along the projected path from a current position of the drill string.

24. The system of claim 23, wherein the storage medium comprises further instructions that cause the processor to:

project the drill string state over a horizon using the TSM and a plurality of candidate control inputs;

calculate a respective cost function for each candidate control input of the plurality of candidate control inputs; and select a candidate control input of the plurality of candidate control inputs based on a lowest cost function being associated with the selected candidate control input.

25. The system of claim 24, wherein each of the respective cost functions comprises one or more of the group:

a difference between the mean of the projected path of the drill string and a portion of a reference path;

the variance of the at least one of the state variables along the projected path;

a difference between a projected state of the drill string and a first constraint; and a difference between a candidate control input and a second constraint.

26. The system of claim 25, wherein:

the first constraint comprises a respective maximum value for one or more of the selected state variables;

the candidate control input comprises one or more control variables selected from a group of a steering angle, a torque, and a weight; and the second constraint comprises a respective maximum value for one or more of the selected control variables.

27. The system of claim 23, wherein the controller is a stochastic model predictive controller (SMPC) and the storage medium comprises further instructions that cause the processor to:

select a new control input using the SMPC that comprises the TSM, a cost function, and a constraint; and update a current control input with the new control input upon occurrence of an event within the group of:

a difference between the current state of the drill string and a desired state of the drill string exceeds a first threshold;

a variance associated with the current state of the drill string exceeds a second threshold; and a distance advanced by the drill string since a prior update of the control input exceeds a third threshold.

28. The system of claim 23, wherein the storage medium comprises further instructions that cause the processor to:

select a new control input using a robust control method selected from a group of a robust Model Predictive Controller (MPC), a tube MPC, and a scenario-based MPC.

29. The system of claim 21, wherein the stochastic approximation method is selected from a group of a generalized polynomial chaos (gPC) method and an arbitrary polynomial chaos (aPC) method.

30. The system of claim 21, wherein reducing the SDM to a TSM comprises substituting a predetermined number of terms of expansion for each probability distribution in the stochastic approximation method and then evaluating one or more expectations.

* * * * *